United States Patent [19]

Kiuchi et al.

[11] Patent Number: 4,875,447

[45] Date of Patent: Oct. 24, 1989

[54] METHOD AND APPARATUS FOR CONTROLLING THE SOLENOID CURRENT OF A SOLENOID VALVE WHICH CONTROLS THE AMOUNT OF SUCTION OF AIR IN AN INTERNAL COMBUSTION ENGINE

[75] Inventors: Takeo Kiuchi; Hidetoshi Sakurai, both of Wako, Japan

[73] Assignee: Honda Giken Kogyo Kabushiki Kaisha, Tokyo, Japan

[21] Appl. No.: 178,807

[22] Filed: Mar. 31, 1988

Related U.S. Application Data

[63] Continuation of Ser. No. 920,544, Oct. 20, 1986, abandoned.

[30] Foreign Application Priority Data

Oct. 21, 1985 [JP] Japan ..... 60-233356
Oct. 21, 1985 [JP] Japan ..... 60-233361

[51] Int. Cl.[4] ..... F02D 41/16

[52] U.S. Cl. ..... 123/339; 123/353; 123/361; 123/585

[58] Field of Search ..... 123/339, 494, 492, 491, 123/361, 352, 357, 399, 585, 353, 354

[56] References Cited

U.S. PATENT DOCUMENTS

| | | | |
|---|---|---|---|
| 3,800,755 | 4/1974 | Klaiber et al. | 123/361 |
| 4,370,960 | 2/1983 | Otsuka | 123/339 |
| 4,378,766 | 4/1983 | Yamazoe et al. | 123/339 |
| 4,386,591 | 6/1983 | Nagase et al. | 123/339 |
| 4,402,294 | 9/1983 | McHugh et al. | 123/494 |
| 4,446,410 | 5/1984 | Yagura et al. | 318/687 |
| 4,660,520 | 4/1987 | Inoue et al. | 123/399 |

FOREIGN PATENT DOCUMENTS

| | | | |
|---|---|---|---|
| 58-176439 | 10/1983 | Japan | 123/339 |
| 2073451 | 3/1981 | United Kingdom | 123/339 |

*Primary Examiner*—Andrew M. Dolinar
*Attorney, Agent, or Firm*—Armstrong, Nikaido, Marmelstein, Kubovcik & Murray

[57] ABSTRACT

A method and apparatus is provided for controlling the solenoid current of a solenoid valve which controls the amount of suction air in an internal combustion engine. A solenoid current control value is calculated as a function of engine operating conditions and a corrected solenoid current control value is determined as a predetermined function of the solenoid current control value. The solenoid valve is controlled as a function of the corrected solenoid current control value. The solenoid valve is controlled by generating a pulse signal having a duty ratio which is a function of the solenoid current control value.

5 Claims, 10 Drawing Sheets

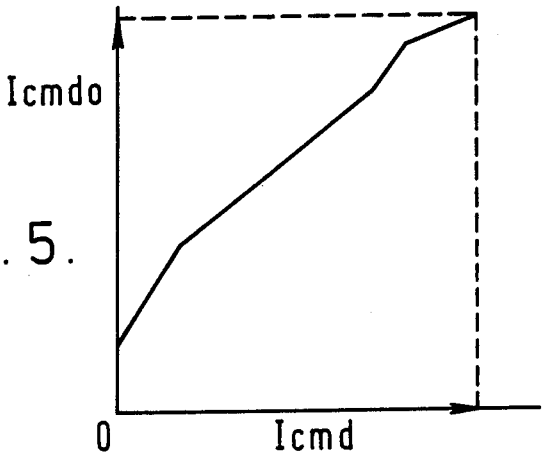
FIG. 5.
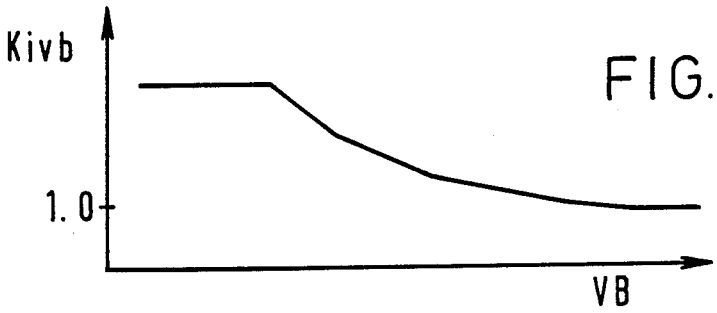
FIG. 6.
FIG. 7.
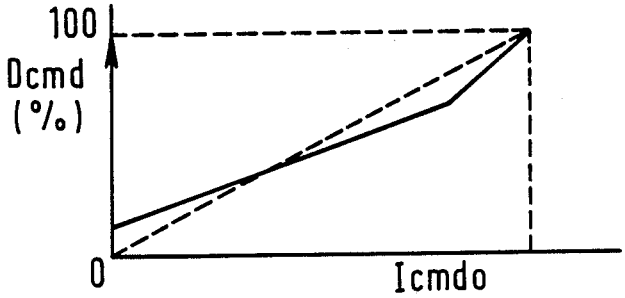

METHOD AND APPARATUS FOR CONTROLLING THE SOLENOID CURRENT OF A SOLENOID VALVE WHICH CONTROLS THE AMOUNT OF SUCTION OF AIR IN AN INTERNAL COMBUSTION ENGINE

This application is a continuation of application Ser. No. 920,544, filed Oct. 20, 1986, now abandoned.

BACKGROUND OF THE INVENTION

This invention relates to a method and apparatus for controlling the solenoid current of a solenoid valve which controls the amount of suction air in an internal combustion engine, and more particularly, to a method and apparatus for controlling the solenoid current of a solenoid valve which controls the amount of suction air in an internal combustion engine wherein the solenoid current is controlled for proportionally controlling the opening of a solenoid valve connected in a by-pass path which couples the upstream and downstream sides of a throttle valve provided in a suction air path.

Referring to FIG. 11, it has been previously proposed that in idling of an internal combustion engine 10, the engine continues to run while a throttle valve 11, provided in a suction air path of the engine, is held in a substantially closed condition. The amount of suction air of the internal combustion engine is controlled by a solenoid valve 12 provided in a by-pass path 13 between the upstream and downstream side of the throttle valve in order to control the rotational speed of the engine (idling rotating speed). Such an idling rotational speed controlling method is disclosed in detail, for example, in Japanese Patent Application No. 60-137445.

The idling rotational speed controlling method in Japanese Patent Application No. 60-137445 includes a step of first calculating a solenoid current control value Icmd by an equation (1) given below in a central processor (CPU) 1 of a microprocessor 4 which, further includes, as shown in FIG. 2, a storage unit or memory 2 and an input/output signal converting circuit or interface 3.

In order to calculate Icmd in the CPU 1, the interface 3 must be supplied with signals from various sensors suitably located in the engine (not shown). This is well known in the art.

$$Icmd=[Ifb(n)+Ie+Ips+Iat+Iac]\times Kpad \quad (1)$$

In equation (1), Ifb(n) is a feedback control term which is calculated in accordance with the flow chart of FIG. 3 which will be hereinafter described. Here, (n) indicates the present time value. The calculations of steps S41 to S46 of FIG. 3 are described as follows:

Step S41 . . . the value Me(n), which is the reciprocal of the engine rotational speed, is read.

Step S42 . . . a deviation Δ Mef is calculated which is the difference between Me(n) thus read and Mrefo which is a reciprocal of a preset aimed idling rotational speed Nrefo.

Step S43 . . . a difference between Me(n) and a preceding time measured value Me for the same cylinder as Me(n) [in the case of a six cylinder engine, Me(n−6)], that is, a coefficient of variation Δ Me of the period, is calculated.

Step S44 . . . an integration term Ii, a proportion term Ip, and a differentiation term Id are calculated in accordance with respective equations indicated in the block of FIG. 3 for the Step S44 using Δ Me and Δ Mef calculated above as well as an integration term control gain Kim, a proportion term control gain Kpm, and a differentiation term control gain Kdm. The control gains are obtained by recalling them from the memory 2 where they were stored in advance.

Step S45 . . . the integration term Ii obtained in the preceding Step S44 is added to Iai(n−1) to obtain Iai(n). Iai(n) obtained here is temporarily stored in the memory 2 so that this may be Iai(n−1) for the next cycle. However, when there is no value stored in the memory 2, some initial value of Iai may be stored in the memory 2 in advance to be read out therefrom as Iai(n−i).

Step S46 . . . Ip and Id calculated at Step S44 are added to Iai(n) calculated at Step S45 to obtain Ifb(n) which is defined as a feedback control term.

The terms in equation (1) other than Ifb(n) are defined as follows:

Ie . . . an addition correction term for adding a predetermined value in accordance with a load of an AC generator (ACG), that is, the field current of the ACG.

Ips . . . an addition correction term for adding a predetermined value when a pressure switch in a power steering hydraulic circuit is turned on.

Iat . . . an addition correction term for adding a predetermined value when the selector position of an automatic transmission AT is in the drive (D) range.

Iac . . . an addition correction term for adding a predetermined value when an air conditioner is operative.

Kpad . . . a multiplication correction term determined in accordance with the atmospheric pressure.

Icmd in equation (1) is calculated in response to TDC pulses produced by a known means when the piston of each cylinder is at an angle of 90° before its top dead center.

Icmd calculated by equation (1) is further converted in the CPU 1, for example, into a duty ratio of pulse signals having a fixed period. The CPU 1 contains a periodic timer and a pulse signal high level time (pulse duration) timer which operates in a synchronized relationship so that pulse signals having a predetermined high level time or duration are successively developed from the microprocessor 4 for each predetermined period. The pulse signals are applied to the base of a solenoid driving transistor 5. Consequently, the transistor 5 is driven to be turned on and off in response to the pulse signals.

Referring to FIG. 2, in response to the on state of the solenoid driving transistor 5, an electric current from battery 6 flows through a solenoid 7 and the transistor 5 to the ground. Accordingly, the opening of a solenoid valve is controlled in accordance with the solenoid current, and an amount of suction air corresponding to the opening of the solenoid valve is supplied to the internal combustion engine to control the idling rotational speed.

Conventionally in a feedback control mode of the engine rotational speed, a determined value Ixref(n) is calculated by equation (2), below, and stored into the memory 2.

$$Ixref(n)=Iai(n)\times Ccrr/m+Ixref(n-1)\times(m-Ccrr)/m \quad (2)$$

Iai(n) in equation (2) is a value calculated at Step S45 of FIG. 3 described above, and Ixref(n−1) indicates the value of the determined value Ixref for the preceding time period. Further, m and Ccrr are selected positive values, and m is selected greater than Ccrr.

The calculation of the value Ixref(n) is effected in response to a TDC pulse when predetermined requirements are met, such as, for example, a requirement that there is no external load such as an air conditioner, as is apparent from the above mentioned Japanese Patent Application No. 60-137445.

When the solenoid valve of the internal combustion engine turns from the feedback control mode to an open loop control mode which is effected during operation other than idling, a pulse signal is developed from the microprocessor 4 in response to Icmd which is equal to the determined value Ixref(n), and the current flowing through the solenoid 7 and hence the opening of the solenoid valve is held to a predetermined value corresponding to the determined value Ixref(n). This is because it is intended that the initial opening of the solenoid valve when the internal combustion engine switches from the open loop control mode back to the feedback control mode may approach as near as possible to the opening corresponding to Icmd in the feedback control mode sc that the time before a stabilized normal control condition is reached may be shortened.

Icmd in the open loop control mode is calculated by the following equation (3), similar to equation (1) above, so that pulse signals corresponding to the Icmd thus calculated may be developed from the microprocessor 4.

$$Icmd=(Ixref+Ie+Ips+Iat+Iac)\times Kpad \quad (3)$$

If Icmd is calculated in this manner and the solenoid current is determined in accordance with pulse signals corresponding to Icmd when the internal combustion engine switches from the open loop control mode back to the feedback control mode, the initial opening is reached in which an external load such as, for example, an air conditioner, is taken in consideration. This is desirable because the time required before an opening corresponding to Icmd for the feedback control mode is reached is further shortened.

The techniques described above, however, have the following drawbacks:

The solenoid current control value Icmd is a value which is determined, in the feedback mode, from the engine rotational speed feedback control term Ifb(n) and the other correction terms as is apparent from equation (1) and is a theoretical value for controlling the opening of a solenoid valve within a range from 0% to 100% in order to bring the engine rotational speed close to an aimed idling rotational speed.

Even if the relationship of Icmd to the opening of the solenoid valve corresponding to the solenoid current, and hence to the amount of suction air, is a proportional one, there is the disadvantage that the intended opening of the solenoid valve and hence the intended amount of suction air which is expected as a result of Icmd cannot be obtained, as will be hereinafter described in detail, if Icmd is converted, for example, into a duty ratio of a pulse signal having a fixed period and the pulse signal is output from the microprocessor 4 to control the solenoid.

However, the change of the opening of the solenoid valve in response to the solenoid current, and accordingly, the change of the amount of suction air, does not exhibit a proportional relationship as seen in FIG. 12, and the change $\Delta Q$ of the amount of suction air Q when the solenoid current I varies by an amount $\Delta I$, is different for each solenoid current region and is not constant. FIG. 12 is a diagram showing the relationship between the solenoid current I of the solenoid valve and the amount of suction air Q.

As a result, even if Icmd is converted into the on time or duration of a pulse signal having, for example, a fixed period as described above so that the solenoid current is controlled by the pulse signal developed in the microprocessor 4, there is the disadvantage that the opening of the solenoid valve which is determined by Icmd, that is, the intended amount of suction air cannot be obtained.

It may easily be understood that such circumstances likewise apply to the open loop control mode.

SUMMARY OF THE INVENTION

The present invention is directed to a method and apparatus for controlling the solenoid current of a solenoid valve which controls the amount of suction air in an internal combustion engine. A solenoid current control value is calculated as a function of engine operating conditions and a corrected solenoid current control value is determined as a predetermined function of the solenoid current control value. The solenoid valve is controlled as a function of the corrected solenoid current control value. The solenoid valve is controlled by generating a pulse signal having a duty ratio which is a function of the solenoid current control value.

BRIEF DESCRIPTION OF THE DRAWINGS

FIG. 5 is a diagram showing a relationship between a solenoid current control value Icmd and a corrected current control value Icmdo.

FIG. 6 is a diagram showing a relationship between a battery voltage VB and a battery voltage correction value Kivb.

FIG. 7 is a diagram showing a relationship between the corrected current control value Icmdo and a pulse duration Dcmd.

DETAILED DESCRIPTION OF THE PREFERRED EMBODIMENT

Figure 2:
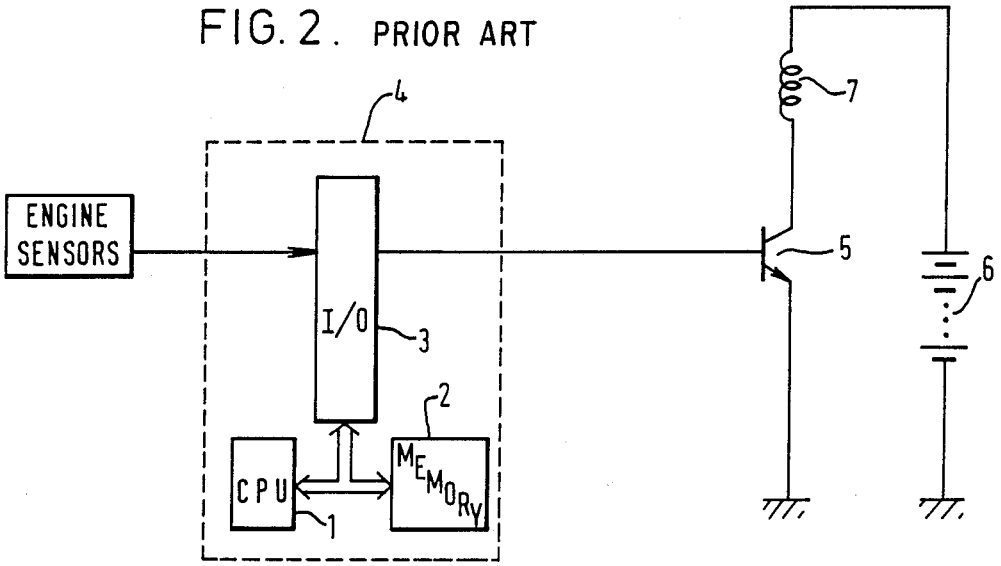
FIG. 2. PRIOR ART
FIG. 2 is a circuit diagram showing a conventional solenoid current controlling device.
Figure 4:
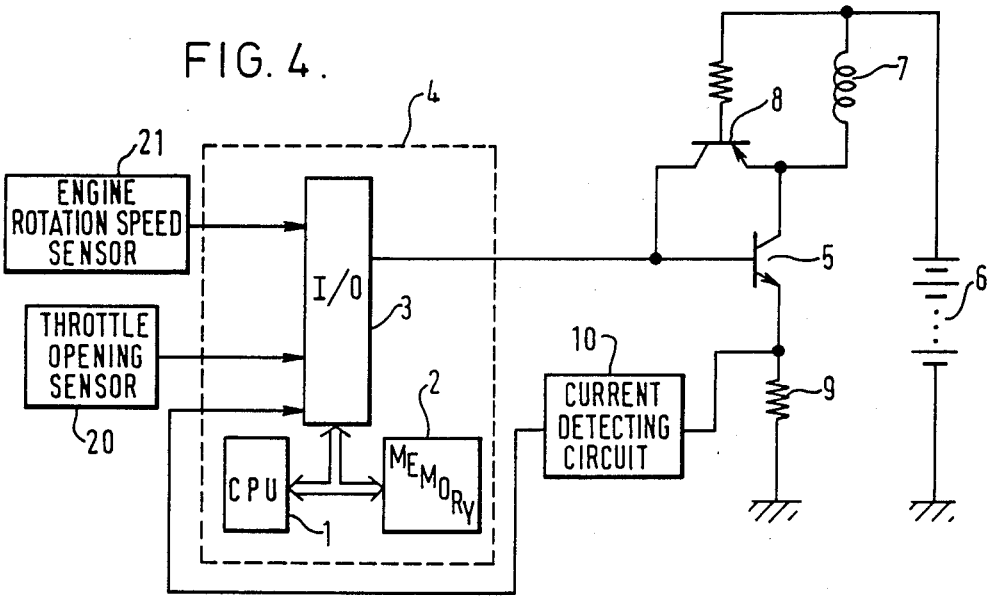
FIG. 4 is a circuit diagram showing an embodiment of solenoid current controlling device of the present invention.

FIG. 4 is a circuit diagram illustrating a solenoid current controlling device of the present invention. Referring to FIG. 4, like reference symbols denote the same or equivalent parts as those of FIG. 2.

When a pulse signal obtained in a manner hereinafter described, is output from a microprocessor 4, it is applied to the base of a solenoid driving transistor 5, and the transistor 5 is driven on or off in response to the pulse signal.

In FIG. 4, when the transistor 5 is on, current from a battery 6 flows through a solenoid 7, the transistor 5 and a resistor 9 to ground. Consequently, the opening of a solenoid valve (not shown) is controlled in response to the solenoid current. When the transistor 5 is interrupted in response to the falling edge of a pulse signal from the microprocessor 4, a back electromotive force is generated in the solenoid 7. Transistor 8 is rendered conductive in response to such a back electromotive force so that the transistor 5 is kept on while the back electromotive force continues to be produced. The entire current variation of the solenoid current may thus be detected as a voltage drop across the resistor 9.

A current detecting circuit 10 supplies the actual current value Iact through the solenoid 7 which is detected as a voltage drop across the resistor 9, to an interface 3. The interface 3 converts the output of the current detecting circuit 10, and accordingly, the actual current value Iact flowing through the solenoid 7, into a digital signal.

Now, the operation of generating a pulse signal which is an output of the microprocessor 4 to which the method of the present invention is applied will be described with reference to FIGS. 1A and 1B which are a flow chart illustrating the operation of the microprocessor 4 with which the present invention is used.

Operation of the flow chart of FIGS: 1A and 1B is started by interruption by TDC pulses.

Step S1 . . . it is determined whether or not the engine is in an engine rotational speed feedback control mode (feedback mode) which stabilizes idling rotational speed to control the solenoid valve, wherein, the opening of the solenoid valve is controlled in response to a solenoid current.

More particularly, when it is determined from a signal supplied from a throttle opening sensor 20 that a throttle valve is in a substantially fully closed condition and it is also determined from a signal supplied from an engine rotational speed sensor 21 that the engine rotational speed is in a predetermined idling rotational speed region, it is determined that the solenoid valve is in the feedback mode, and the program advances to Step S3. In any other case, the program advances to Step S2.

Step S2 . . . as a feedback control term Ifb(n), a preceding determined value Ixref which has been stored in the memory 2 at Step S6 is adopted. When there is no determined value Ixref stored in the memory 2, a value likely to the determined value which has been stored in memory 2 in advance, is read out as a determined value Ixref. The program then advances to Step S7 described below.

Figure 3:
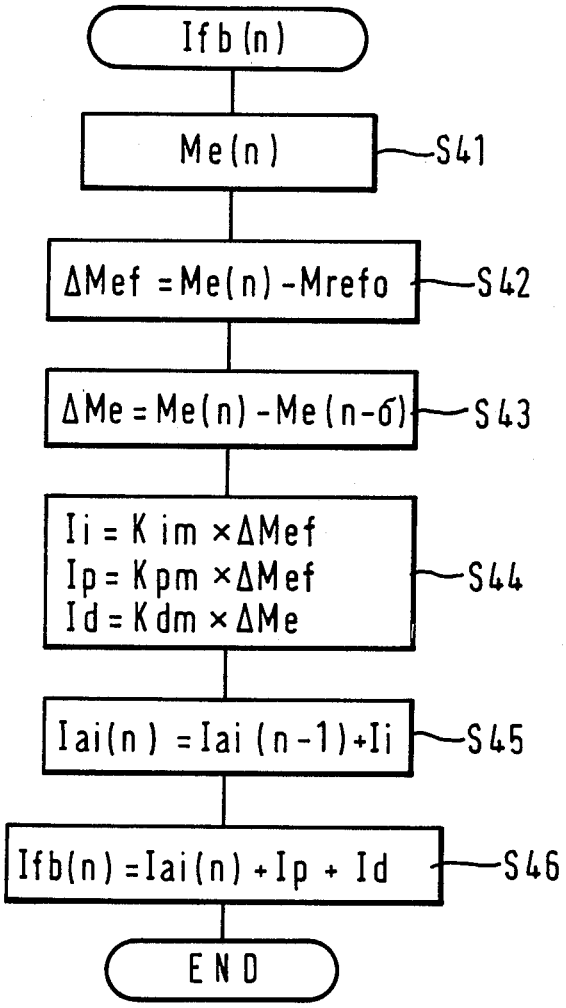
FIG. 3 is a flow chart for calculating a feedback control term Ifb(n).

Step S3 . . . Ifb(n) is calculated by calculation for the engine rotational speed feedback control mode in such a manner as described above in connection with FIG. 3.

Step S4 . . . it is determined whether or not the predetermined requirements for allowing appropriate calculation of the determined value Ixref(n) at Step S5 described below, are met. Particularly, it is determined whether or not the predetermined requirements are met in that the car speed is lower than a predetermined level V1 and that there are no external loads such as an air conditioner and power steering. When the determination is negative, the program advances to Step S7, and when it is affirmative, the program advances to Step S5. It is to be noted that while it is necessary to provide various sensors which develop outputs applied to the interface 3 in order to determine the requirements as described above, this is well known in the art and hence such sensors are not shown in FIG. 4.

Step S5 . . . a determined value Ixref(n) is calculated using equation (2) described above.

Step S6 . . . the determined value calculated at Step S5 is stored in the memory 2.

Step S7 . . . values of the individual correction terms of equation (1) or (3), that is, the addition correction terms Ie, Ips, Iat and Iac and the multiplication correction term Kpad, are read in. In order to read in the various values, it is necessary to provide sensors which provide sensor outputs to the interface 3, similarly to Step S4. However, because this is also well known in the art, such sensors are not shown in FIG. 4.

Step S8 . . . a solenoid current control value Icmd is calculated by equation (1) above. Where Step S2 has been passed through, the value Icmd is calculated by equation (3).

In the present invention, the addition and multiplication correction terms may not necessarily be limited to those appearing in equation (1) or (3), and other correction terms may be added. However, it is naturally necessary to read in values for such additional correction terms in advance at Step S7 above.

Step S9 . . . an Icmd—Icmdo table which has been stored in advance in the memory 2 is read out in response to the solenoid current control value Icmd to determine a corrected current control value Icmdo. FIG. 5 is a diagram showing an example of the relationship between the solenoid current control value Icmd and the corrected current control value Icmdo.

The provision of the Icmd—Icmdo table is necessary for the following reason. Icmd is a value which is determined, in the feedback mode, from the engine rotational speed feedback control term Ifb(n) and the other correction terms as seen from equation (1) and is a theoretical value for controlling the opening of a solenoid valve within a range from 0% to 100% in order to bring the engine rotational speed close to an aimed idling rotational speed.

Figure 12:
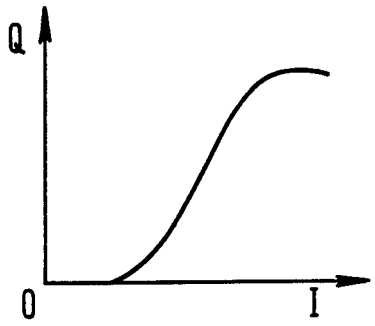
FIG. 12 is a diagram showing the relationship between the solenoid current I and the amount of suction air Q.

However, as described hereinabove, Icmd and the actual opening of the solenoid valve do not correspond proportionally to each other. Therefore, it is necessary to correct Icmd taking into account the solenoid current (I) — suction air amount (Q) characteristic of FIG. 12 so that the actual opening of the solenoid valve may be controlled appropriately between 0% and 100% in accordance with Icmd. For this reason, the Icmd—Icmdo table is provided.

Figure 13:
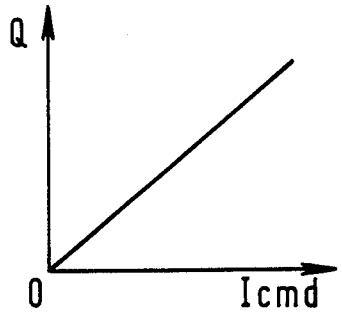
FIG. 13 is a diagram showing the relationship between the corrected solenoid current control value Icmd and the amount of suction air Q.
Figure 14A:
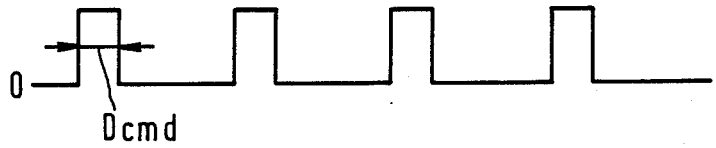
FIGS. 14(*a*)–14(*f*) are waveform diagrams of Dcmd and integrated values of Iact.
Figure 14B:
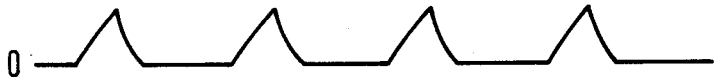
Figure 14C:
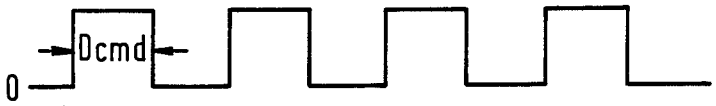
Figure 14D:
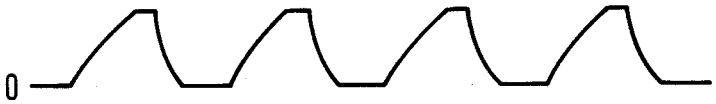
Figure 14E:
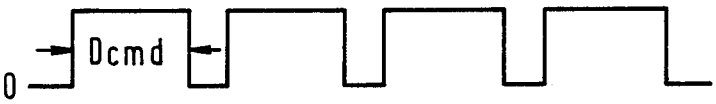
Figure 14F:
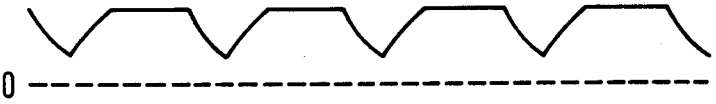

In addition, according to the present invention, by conversion of Icmd into Icmdo, the relationship between Icmd and the amount of suction air (Q) will be a proportional one which is uniform over the entire region of the solenoid current as seen in FIG. 13. Also, as can be understood from the foregoing description, the Icmd—Icmdo table of FIG. 5 can be composed from the diagrams of FIGS. 12 and 13.

Step S10 . . . the corrected current control value Icmdo determined at Step S9 above is stored in the memory 2.

Step S11 . . . an actual current value Iact supplied from the current detecting circuit 10 is read in.

Step S13 . . . an integration term Di(n) for current feedback control is calculated in accordance with the equation indicated in block S13 using a preceding time corrected current control value Icmdo(n−1) which has been stored at Step S9 above, the present actual current value Iact read in at Step S11 above, an integration term control gain Kii which has been stored in advance in the memory 2, and a preceding time integration term Di(n−1). Where there is no Di(n−1) stored in the memory 2, a preceding determined value Dxref which has been stored in the memory 2 at Step S22 described below is used as Di(n−1). (This value is stored in a backup RAM within memory 2 which is powered by an independent power supply).

Similarly, since Icmdo(n−1) is not yet stored at Step S10 above immediately after the ignition switch has been turned on a value of Icmdo corresponding to Icmd=0 of FIG. 5 is used as Icmdo(n−1).

Step S15 . . . Di(n) calculated at Step S13 is stored in the memory 2.

Step S17 . . . a present time actual current value Iact(n) is compared with the preceding time corrected current control value Icmdo(n−1) stored in the memory 2 at Step S10 in order to determine whether or not it is smaller than Iact(n). When the determination is affirmative, that is, when the actual current value Iact(n) is smaller than the value Icmdo(n−1), the program advances to Step S18, but when the determination is negative, the program advances to Step S19.

Step S18 . . . "1" is set as a present time flag Fi(n). The flag is temporarily stored in the memory 2 so that it can be used as a flag Fi(n−1) in the next cycle. The program then goes to Step S20.

Step S19 . . . "0" is set as a present time flag Fi(n). The flag is temporarily stored in the memory 2 so that it can be used as a flag Fi(n−1) in the next cycle.

Step S20 . . . if the present time flag Fi(n) is equal to the preceding flag Fi(n−1), Step S21 and Step S22 are bypassed and the program advances to Step S24. When the flags are not equal to each other, or in other words, when the present time actual current value Iact(n) crosses the preceding corrected current control value Icmdo(n−1), an appropriate determined value Dxref(n) for current feedback control can be obtained, and the program advances to Step S21.

Step S21 . . . a determined value Dxref(n) as defined by equation (4) below is calculated.

$$Dxref(n)=Di(n)\times Ccrr/m+Dxref(n-1)\times(m-Ccrr)/m \quad (4)$$

Di(n) in equation (4) is a value calculated at Step S13 above and stored in the present time value memory while Dxref(n−1) indicates a preceding time value of the determined value Dxref. Further, m and Ccrr are predetermined positive numbers, and m is selected greater than Ccrr.

Step S22 . . . the present determined value Dxref calculated at Step S21 is stored in the memory 2.

Step S24 . . . a feedback control term Dfb(n) is calculated by equation (5A) below using the preceding corrected current control value Icmdo(n−1) stored at Step S10 above, the present time actual current value Iact(n) read in at Step S11 above, a proportion term control gain Kip which has been stored in advance in the memory 2, and the integration term Di(n) stored in the present time value memory.

$$Dfb(n)=Dp(n)+Di(n) \quad (5A)$$

$$Dp(n)=Kip[Icmdo(n-1)-Iact(n)] \quad (5B)$$

$$Di(n)=Di(n-1)+Kii[Icmdo(n-1)-Iact(n)] \quad (5C)$$

Calculations of current deviations of the integration term Di(n) and the proportion term Dp(n) of equations (5C) and (5B) are effected based on the preceding corrected current control value Icmdo(n−1) and the present time actual current value Iact(n). This is because even if the corrected current control value Icmdo changes, the actual current value Iact does not immediately show a change due to the inductance of the solenoid and it takes a period of time for the actual current Iact to become stabilized after a change in Icmdo. Hence, calculations of the integration term Di(n) and the proportion term Dp(n) based on deviations of the present time values of the corrected current control value Icmdo and the actual current value Iact will cause errors in the individual terms, resulting in an error in the calculation of an appropriate feedback control term Dfb(n). Further, an appropriate determined Dxref at Step S21 above will not be assured.

The integration term Di(n) and the proportion term Dp(n) at Step S24 are not electric current values but values, for example, converted into high level pulse durations (hereinafter referred to as pulse durations) of pulse signals having a fixed period. This is because the specified terms obtained as electric current values are converted into pulse durations using a known table of electric current value I— pulse duration D. Accordingly, the feedback control term Dfb(n) is also obtained as a pulse duration. In addition, the determined value Dxref(n) of the integration term Di(n) obtained at Step S21 above is also a pulse duration.

Step S26 . . . limit checking of Dfb(n) is effected in a manner as hereinafter described with reference to FIG. 8.

Step S27 . . . the voltage VB of the battery 6 is read by a sensor (not shown).

Step S28 . . . a VB - Kivb table, which has been stored in advance in the memory 2, is read out to determine a battery voltage correction value Kivb based upon the battery voltage VB. FIG. 6 is a diagram showing the relationship between the battery voltage VB and the battery voltage correction value Kivb. As is apparent from the diagram, the battery voltage correction value Kivb is "1.0" when the battery voltage VB is higher than a predetermined voltage (for example, higher than 12 V), but if VB falls, the value will become correspondingly higher than 1.0 to maintain constant current.

Step S29 . . . an Icmdo—Dcmd table, which has been stored in advance in the memory 2, is read out to determine a pulse duration Dcmd(n) from the corrected current control value Icmdo(n) stored at Step S10 above. FIG. 7 is a diagram showing the relationship between the corrected current control value Icmdo and the pulse duration Dcmd.

The reason for using the Icmdo—Dcmd table, as indicated by the solid line in FIG. 7, is that in the feedback mode, Icmd is a theoretical value for controlling the opening of the solenoid valve between 0% and 100% in order to adjust the engine rotational speed to an aimed idling rotational speed. Meanwhile, Icmdo is a current control value which is obtained by correcting Icmd taking the characteristics of the solenoid valve into consideration so that the actual opening of the solenoid valve is controlled linearly from 0% to 100%.

When a pulse duration Dcmd(n) is determined in accordance with the corrected current control value Icmdo, a table is commonly used which defines the relationship between Icmdo and Dcmd in a linear proportional manner as indicated by the broken line in FIG. 7. However, if Dcmd(n) is determined in this manner and a pulse duration Dout(n) of a pulse signal, which is produced in accordance with Dcmd(n), changes the deviation of the solenoid current and hence the actual amount of suction air from the corrected current control value Icmdo changes. Hence an error may appear. Thus, the table indicated by the solid line in FIG. 7 is provided in order to compensate for such an error.

It is to be noted that the reason why an error may appear if Dcmd is determined using the table as indicated by a broken line in FIG. 7, is that if the pulse duration Dcmd changes as shown in FIGS. 14(*a*), 14(*c*) and 14(*e*), the ratios between an integrated value of Dcmd and integrated value of the actual solenoid current flowing in response to the Dcmd will vary as shown in FIGS. 14(*b*), 14(*d*) and 14(*f*).

If the pulse duration Dout(n) of a pulse signal which is generated and is output from the microprocessor 4, varies, then the solenoid current varies relative to the corrected current control value Icmdo, that is, a deviation of the solenoid current occurs, and hence, the amount of actually sucked air varies and an error will appear. The table described above defines the relationship between Icmdo and Dcmd in such a manner as to eliminate such an error.

Step S30 . . . a pulse duration Dout(n) of a pulse signal, which is a final output of the microprocessor 4, is calculated by equation (6) below using Dcmd(n) determined at Step S29 above, Dfb(n) calculated at Step S24 and checked for limits at Step S26, and the battery voltage correction value Kivb determined at Step S28.

$$Dout(n)=Kivb\times[Dcmd(n)+Dfb(n)] \quad (6)$$

Thus, Dout(n) is determined by adding Dfb(n) of the current feedback control system which is determined based on a deviation of the present time actual current value Iact(n) from the preceding corrected current control value Icmdo(n−1) to Dcmd(n) which is determined based on the corrected current control value Icmdo for the engine rotational frequency feedback control system to determine a pulse duration and by multiplying the pulse duration thus calculated by the battery voltage correction value Kivb.

Step S31 . . . limit checking is effected in a manner hereinafter described with reference to FIG. 9. After this, the process returns to the main program. Thus, the microprocessor 4 successively develops pulse signals having the pulse duration Dout(n).

Figure 8:
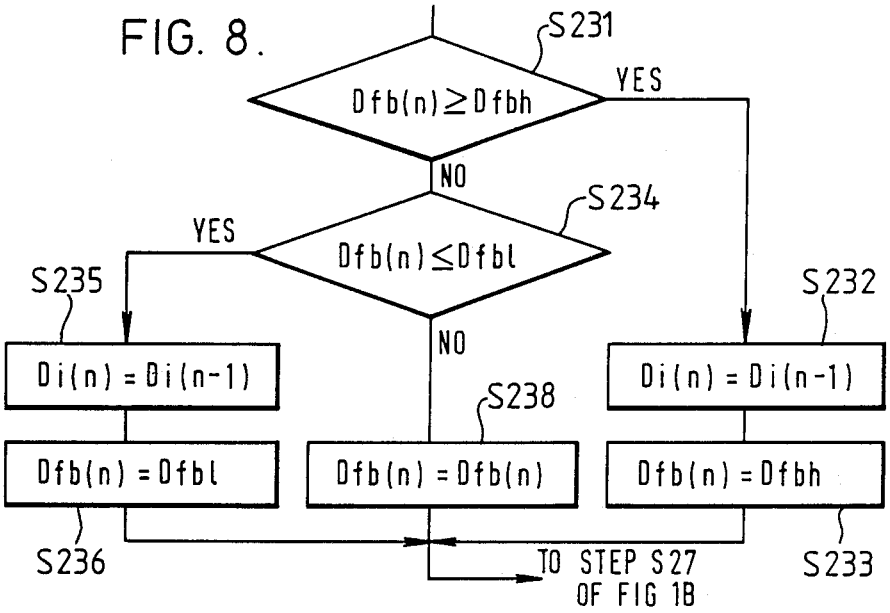
FIG. 8 is a flow chart illustrating contents of calculations at Step S26 of FIG. 1B.

FIG. 8 is a flow chart illustrating the contents of the calculation at Step S26 of FIG. 1.

Step S231 . . . it is determined whether or not Dfb(n) calculated at Step S24 of FIG. 1 is greater than a certain upper limit Dfbh. When the determination is negative, the program advances to Step S234, and when the determination is affirmative, the program advances to Step S232.

Step S232 . . . the preceding integration value Di(n−1), which is stored in the memory 2, is stored as the present integration value Di(n).

Step S233 . . . Dfb(n) is set to its upper limit, that is, Dfbh. The program then advances to Step S27 of FIG. 1.

Step S234 . . . it is determined whether or not Dfb(n) is smaller than a certain lower limit Dfbl. When the determination is negative, Dfb(n) is considered to be within an appropriate range defined by the limits, and the program advances to Step S238. However, when the determination is affirmative, the program goes to Step S235.

Step S235 . . . the preceding integration value Di(n−1) is stored in the present time value memory in a similar manner as at Step S232 above.

When Dfb(n) is determined to be out of the range defined by the upper and lower limits as a result of the processing at Step S232 and Step S235 above, the integration term will not be updated by the next time calculation at Step S13 (FIG. 1). If the integration term is otherwise updated while Dfb(n) is out of the range, the value of the integration term will be extraordinary so that when a normal condition in which Dfb(n) is within the range is restored, an appropriate feedback control term Dfb(n) will not be obtained smoothly. Thus, the elimination of updating of the integration term is intended to eliminate such a condition.

Step S236 . . . Dfb(n) is set to its lower limit value, that is, Dfbl. After this, the program advances to Step S27 of FIG. 1.

Step S238 . . . Dfb(n) is set to the value calculated at Step S24 of FIG. 1. After this, the program advances to Step S27 of FIG. 1.

Figure 9:
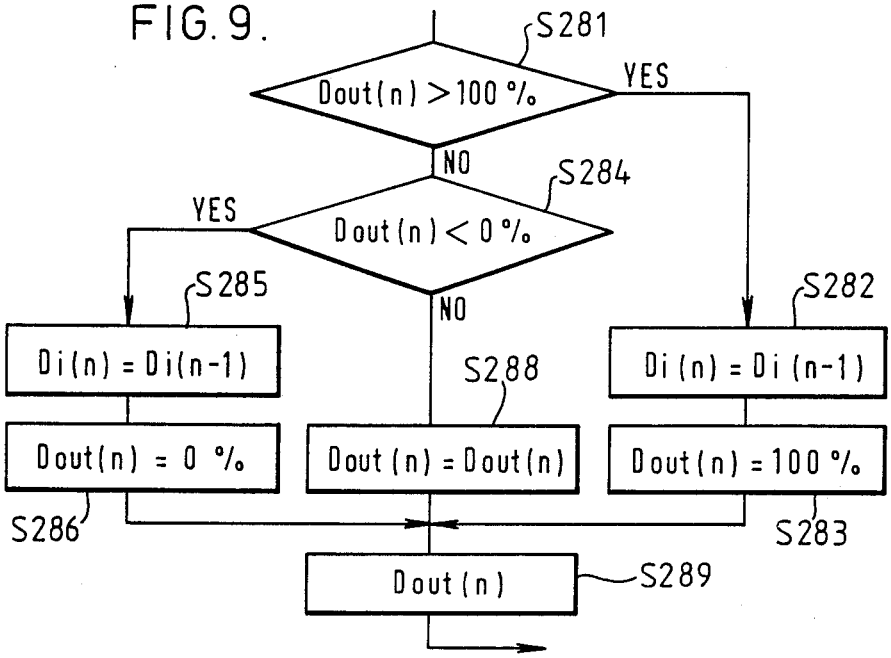
FIG. 9 is a flow chart illustrating contents of calculations at Step S31 of FIG. 1B.

FIG. 9 is a flow chart illustrating contents of calculations at Step S31 of FIG. 1.

Step S281 . . . it is determined whether or not Dout(n), calculated at Step S30 of FIG. 1, is greater than the 100% duty ratio of the output pulse signals of the microprocessor 4. When the determination is negative, the program advances to Step S284, and when the determination is affirmative, the program advances to Step S282.

Step S282 . . . the preceding integration value Di(n−1) which is stored in the preceding time value memory is stored in the memory 2 as the present integration value Di(n).

Step S283 . . . Dout(n) is set to the 100% duty ratio of the output pulse signals. The reason why Dout(n) is limited to the 100% duty ratio of the output pulse signals is that even if the solenoid current is controlled based on Dout(n) which is greater than the 100% duty ratio, a solenoid current actually corresponding thereto can not be obtained.

Step S284 . . . it is determined whether or not Dout(n) is smaller than the 0% duty ratio of the output pulse signals of the microprocessor 4. When the determination is negative, Dout(n) is considered to be within an appropriate range defined by the limit, and the program advances to Step S288. However, when the determination is affirmative, the program advances to Step S285.

Step S285 . . . the preceding integration value Di(n−1) is stored in the present time value memory in a similar manner as in Step S282 above.

When Dout(n) is out of the range defined by the upper and lower limits as a result of the processings of Step S282 and Step S285 above, the integration term will not be updated by the next time calculation at Step S13 (FIG. 1). The reason why the integration term is not updated is similar to that described above in connection with Step S235.

Step S286 . . . Dout(n) is set to the 0% duty ratio of the output pulse signals. The reason why Dout(n) is limited to the 0% duty ratio of the output pulse signals is that even if the solenoid current is controlled based on Dout(n) which is smaller than the 0% duty ratio, a solenoid current actually corresponding thereto can not be obtained.

Step S288 . . . Dout(n) is set to the value calculated at Step S30 of FIG. 1.

Step S289 . . . Dout(n) is outputted. In response to this, the microprocessor 4 successively develops pulse signals of a duty ratio corresponding to Dout(n) which are applied to the solenoid driving transistor 5.

Figure 1A:
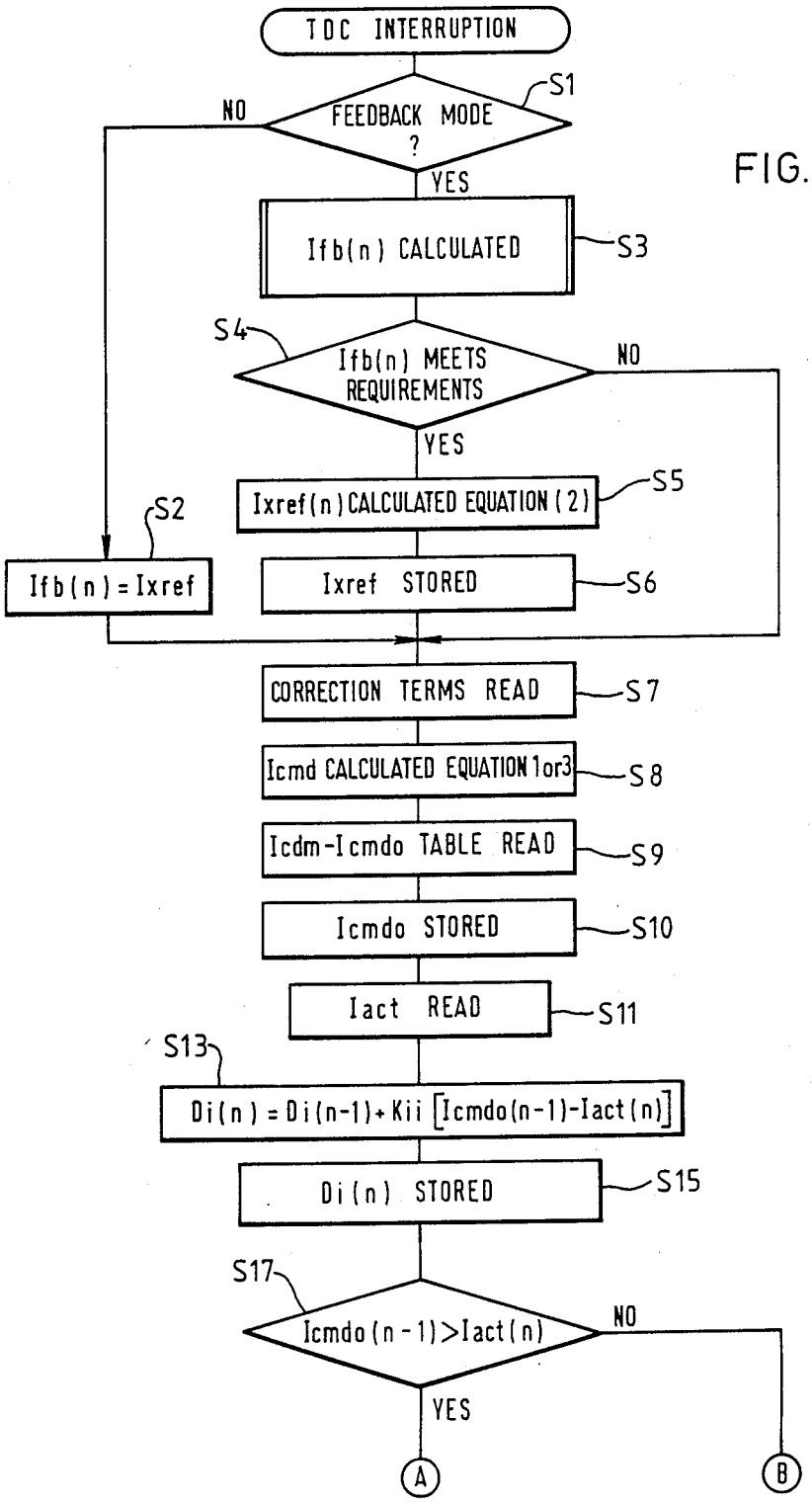
FIGS. 1A and 1B are a flow chart illustrating operation of a microprocessor to which an embodiment of the present invention is applied.
Figure 1B:
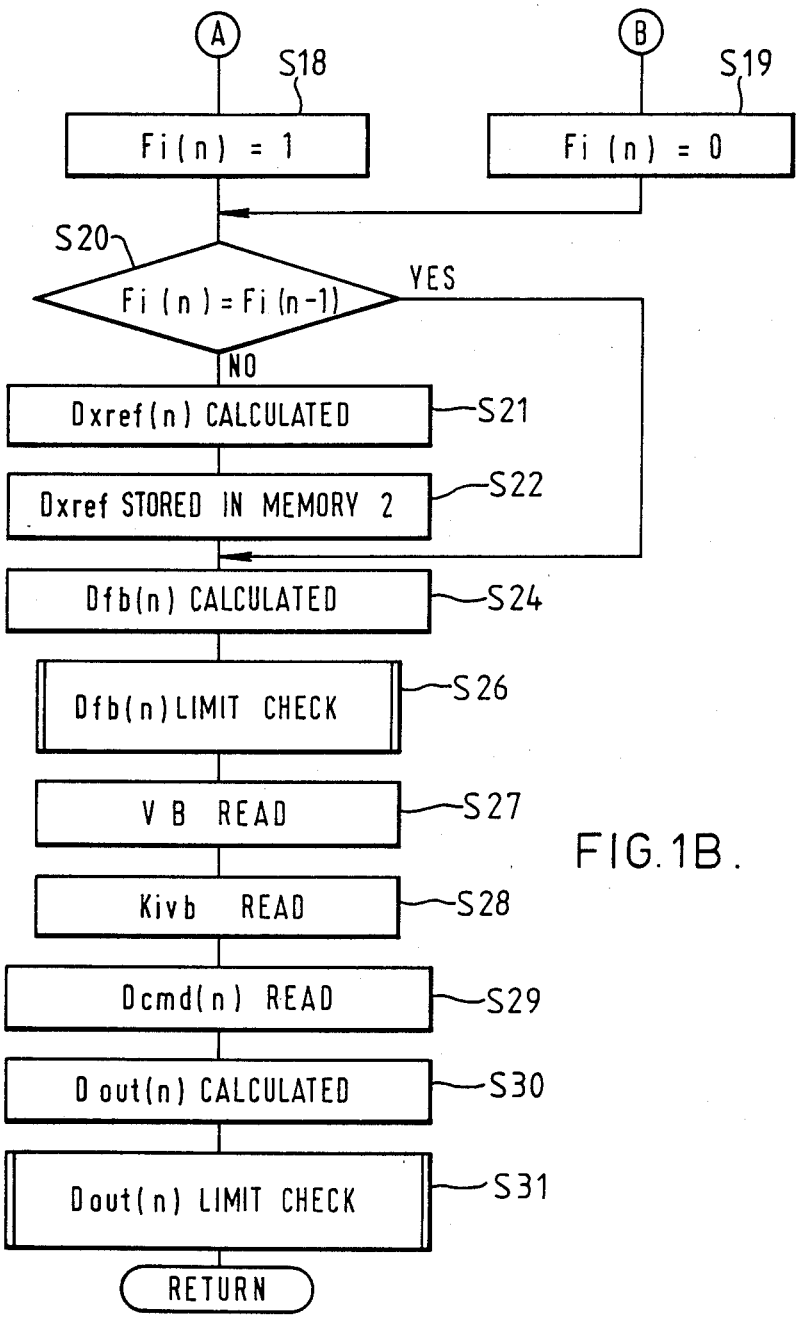
Figure 10:
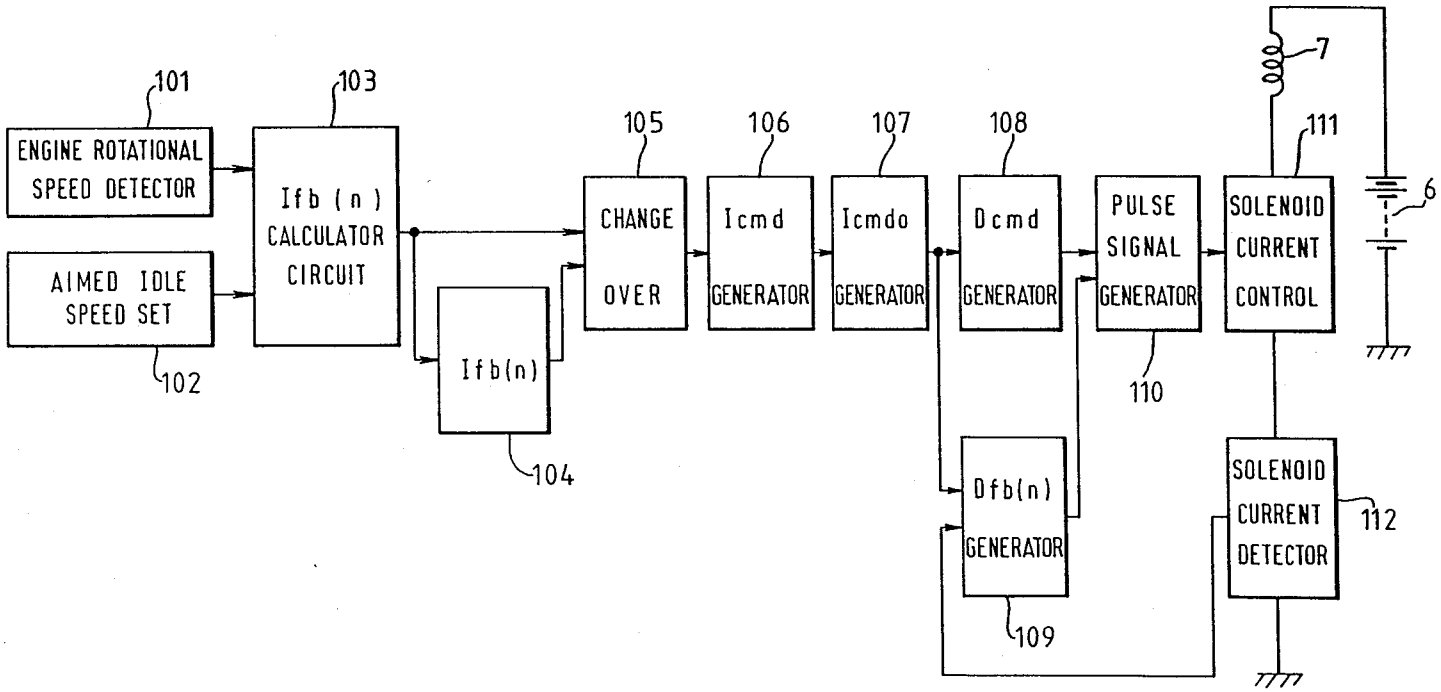
FIG. 10 is a block diagram of a solenoid current controlling device of the present invention.
Figure 11:
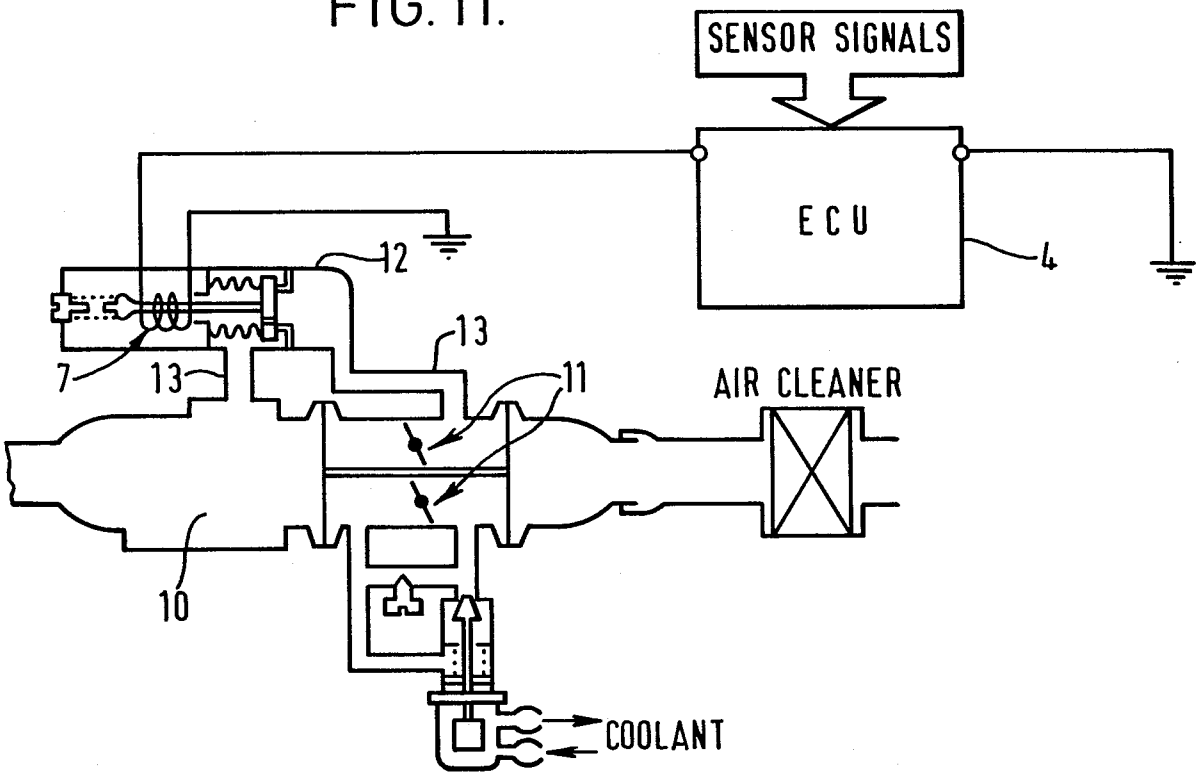
FIG. 11 is a schematic illustration of the throttle valve and solenoid valve in combination with an engine.

FIG. 10 is a block diagram illustrating the general functions of a solenoid current controlling device to which the present invention using the flow chart of FIGS. 1A and 1B is applied. Referring to FIG. 10, an engine rotational speed detecting means 101 detects the actual rotational speed of an engine and outputs Me(n), a reciprocal number of the engine rotational speed. An aimed idling rotational speed setting means 102 determines an aimed idling rotational speed Nrefo in accordance with the running conditions of the engine and develops a reciprocal number or value Mrefo.

An Ifb(n) calculating means 103 calculates a feedback control term If(b) from Me(n) and Mrefo and outputs it to a change-over means 105 and an Ifb(n) determining and storing means 104. The Ifb(n determining and storing means 104 determines an integration term Iai(n) of the feedback control term Ifb(n) in accordance with equation (2) above and outputs a latest determined value Ixref.

The change-over means 105 supplies Ifb(n) output from the Ifb(n) calculating means 103 to an Icmd generating means 106 when a solenoid valve (not shown), the opening of which is proportionally controlled in response to an electric current flowing through a solenoid 7, is in the engine rotational speed feedback control mode. On the other hand, when the solenoid valve is in the open loop control mode, the change-over means 105 delivers the latest determined value Ixref output from the Ifb(n) determining and storing means 104 to the Icmd generating means 106.

The Icmd generating means 106 calculates a solenoid current control value Icmd, for example, in accordance with equation (1) above when Ifb(n) is received. However, when Ixref is received, the Icmd generating means 106 calculates a solenoid current control value Icmd, for example, in accordance with equation (3) above.

While not shown in the drawings, the correction terms of the equations (1) and (3) are supplied to the Icmd generating means 106. This Icmd is supplied to an Icmdo generating means 107.

The Icmdo generating means 107 reads out, in response to Icmd supplied thereto, an Icmd—Icmdo table which has been stored in advance and determines and outputs a corrected current control value Icmdo. This Icmdo is supplied to a Dcmd generating means 108 and a Dfb(n) generating means 109.

The Dcmd generating means 108 reads out, in response to Icmdo supplied thereto, an Icmdo—Dcmd table which has been stored in advance and determines a pulse duration Dcmd corresponding to the Icmdo and supplied it to a pulse signal generating means 110.

The Dfb(n) generating means 109 calculates a feedback control term Dfb(n) by equation (5A) from the Icmdo and an actual current value Iact which is an output of a solenoid current detecting means 112 which detects the electric current flowing through the solenoid 7 in response to on/off driving of solenoid current controlling means 111. The Dfb(n) generating means 109 supplies Dfb(n) thus calculated to a Dfb(n) determining and storing means 110.

The pulse signal generating means 110 corrects the pulse duration Dcmd supplied thereto in accordance with Dfb(n) and outputs a pulse signal having a corrected pulse duration Dout. The solenoid current controlling means 111 is driven on and off in response to the pulse signal supplied thereto. As a result, the electric current from battery 6 flows through the solenoid 7, the solenoid current controlling means 111 and the solenoid current detecting means 112 to ground.

It is to be noted that the foregoing description relates to a situation wherein a pulse duration Dout is determined based on a pulse duration developed from a feedback control system of an engine rotational speed and another pulse duration Dfb(n) developed from a feedback control system of a solenoid current, and the solenoid current is controlled in response to a pulse signal having the Dout thus determined. However, it can be easily understood that the present invention can be applied to a solenoid current controlling method and apparatus as described hereinabove in connection with FIG. 2, wherein the solenoid current is controlled only by feedback control of the engine rotational speed without effecting feedback control of the solenoid current.

Since conversion of a current control value such as a solenoid current control value or a corrected current control value for controlling the opening of a solenoid valve between 0% and 100% into a duty ratio of a pulse signal is effected in a manner such that the valve opening, which is based upon the current control value, may actually be obtained, it is possible to obtain an amount of suction air which is the function of the current control value.

Further, since the relationship between the solenoid current control value Icmd and the amount of suction air is a proportional relationship uniform over the entire region of the solenoid current by conversion of Icmd into a corrected current control value Icmdo, the amount of suction air determined by Icmd can be obtained in a stabilized manner over the entire region of the solenoid current, irrespective of increases or decreases of the load to the engine.

As a result, the amount of suction air at and after an initial stage of the feedback mode of the engine rotational speed is appropriate, and hence the engine rotational speed can be held stably to an aimed idling rotational speed.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

I claim:

1. A method of controlling a solenoid current of a solenoid valve which controls the amount of suction air of an internal combustion engine, said control valve being a proportionally controllable valve whose opening degree can be controlled in proportion to supply current, said method comprising the steps of:

detecting engine rotational speed;

setting an aimed idling speed corresponding to a predetermined idling speed;

calculating a feedback control valve as a function of a deviation signal between said engine rotational speed and said predetermined idling speed;

calculating a solenoid current control value based upon the feedback control valve;

determining a corrected solenoid current control value as a function of the solenoid current control value, the function being for converting from the solenoid current control value to the corrected solenoid current control value to make the opening degree of said control valve proportional to said solenoid opening degree control value;

determining a pulse duration signal as a function of the corrected solenoid correct control value, the function being for converting from the corrected solenoid current control value to an output current of a driving circuit to make input-output characteristics in the driving circuit of the solenoid valve proportional to the corrected solenoid current control value; and controlling said solenoid, current as a function of said, pulse duration signal.

2. A method of controlling the solenoid current of a solenoid valve which controls the amount of suction air in an internal combustion engine, said control valve being a proportionally controllable valve whose opening degree can be controlled in proportion to supply current and being driven by a drive circuit whose output current is in response to a pulse train signal having a duty ratio, said method comprising the steps of:

detecting engine rotational speed;

setting an aimed idling speed corresponding to a predetermined idling speed;

calculating a first feedback control term as a function of a deviation signal between said engine rotational speed and said predetermined idling speed;

calculating a solenoid current control value based upon the first feedback control term;

determining a corrected solenoid current control value as a function of the solenoid current control value, the function being for converting from the solenoid current control value to the corrected solenoid current control value to make the opening degree of the control valve proportional to said solenoid opening degree control value;

generating a pulse duration signal which is a function of the corrected solenoid current control value wherein the integrated value of the pulse duration signal varies in a constant relationship with the integrated value of the solenoid current in order to compensate a characteristic of said driving circuit;

detecting actual solenoid current flowing through the solenoid of said solenoid valve;

calculating a second feedback control term as a function of said pulse duration signal and said actual solenoid current; and applying said solenoid current as a function of said pulse duration signal and said second feedback control term.

3. An apparatus for controlling the solenoid current of a solenoid valve which controls the amount of suction air in an internal combustion engine, said apparatus comprising:

(a) engine rotational speed detector means for detecting engine rotational speed;

(b) aimed idle speed setting means for generating a signal corresponding to a predetermined idling speed;

(c) first calculating means coupled to said engine rotational speed detector means and said aimed idle speed setting means for calculating a feedback control term (Ibf(n)) as a function of an integration term (Iai), a proportion term (Ip), and a differentiation term (Id);

(d) first determining and storing means coupled to said first calculating means, for determining an integration term (Iai(n)) of the feedback control term (Ifb(n)) and for determining a determined value (Ixref) in accordance therewith;

(e) changeover means coupled to said first calculating means and said first determining and storing means for selecting the output of one of said first calculating means or said first determining and storing means;

(f) first signal generating means coupled to said changeover means for generating a solenoid current control value (Icmd) as a function of the output of said changeover means;

(g) second signal generating means coupled to the output of said first signal generating means, for generating a corrected current control value (Icmdo) corresponding to the current control value;

(h) third signal generating means coupled to said second signal generating means for generating a pulse duration signal (Dcmd) corresponding to the corrected current control value;

(i) solenoid current detector means, coupled to said solenoid valve, for detecting the current (Iact) flowing through the solenoid of said solenoid valve;

(j) fourth signal generating means coupled to the output of said second signal generating means and said solenoid current detector means for generating a feedback control term (Dfb(n)) as a function of the correct current control valve signal and the solenoid current;

(k) pulse signal generating means coupled to said third signal generating means and said fourth signal generating means for generating a solenoid control pulse (Dout), wherein said solenoid control pulse is applied to said solenoid for energizing said solenoid.

4. An apparatus as set forth in claim 3, wherein said second signal generating means includes a current control value (Icmd) — corrected current control value (Icmdo) table.

5. An apparatus as set forth in claim 3, wherein said third signal generating means includes a corrected current control value (Icmdo) — pulse duration signal (Dcmd) table.

* * * * *